US009475171B2

(12) United States Patent
Wu

(10) Patent No.: US 9,475,171 B2
(45) Date of Patent: Oct. 25, 2016

(54) LOW MAGNETIC CHEMICAL MECHANICAL POLISHING CONDITIONER

(71) Applicant: Kinik Company, Taipei (TW)
(72) Inventor: Tian-Yeu Wu, New Taipei (TW)
(73) Assignee: KINIK COMPANY, Taipei (TW)

( * ) Notice: Subject to any disclaimer, the term of this patent is extended or adjusted under 35 U.S.C. 154(b) by 0 days.

(21) Appl. No.: 14/561,022

(22) Filed: Dec. 4, 2014

(65) Prior Publication Data

US 2015/0174730 A1 Jun. 25, 2015

(30) Foreign Application Priority Data

Dec. 20, 2013 (TW) ..... 102147394 A

(51) Int. Cl.

| | |
|---|---|
| ***B24B 53/00*** | (2006.01) |
| ***B24B 53/017*** | (2012.01) |
| ***B03C 1/033*** | (2006.01) |
| ***B03C 1/12*** | (2006.01) |
| ***B03C 1/16*** | (2006.01) |

(52) U.S. Cl.

CPC ..... *B24B 53/017* (2013.01); *B03C 1/0332* (2013.01); *B03C 1/12* (2013.01); *B03C 1/16* (2013.01); *B03C 2201/20* (2013.01)

(58) Field of Classification Search

CPC ..... B24B 53/07; B03C 1/0332; B03C 1/12; B03C 1/16; B03C 2201/20
USPC ..... 451/526–540, 443; 209/215
See application file for complete search history.

(56) References Cited

U.S. PATENT DOCUMENTS 2,900,076 A * 8/1959 Israelson ..... A61J 3/10 100/91
2,999,275 A * 9/1961 Blume, Jr. ..... C04B 35/2683 156/243
3,057,477 A * 10/1962 Maximiliano ..... A61J 3/10 192/84.2
3,123,951 A * 3/1964 Kuris et al. ..... B08B 3/12 125/11.01
3,956,108 A * 5/1976 Young ..... G03G 15/0887 118/603
4,255,164 A * 3/1981 Butzke ..... B24B 13/01 451/42
4,967,912 A * 11/1990 Schonberg ..... B03C 1/18 100/902
4,968,326 A * 11/1990 Wiand ..... B24D 3/06 51/293
5,454,750 A * 10/1995 Cosmano ..... B24D 3/34 451/526
5,481,983 A * 1/1996 Guzman ..... B03C 1/30 104/279
5,611,826 A * 3/1997 Ryoke ..... B24D 3/28 360/128
5,669,941 A * 9/1997 Peterson ..... B24D 3/28 51/295

(Continued)

FOREIGN PATENT DOCUMENTS

CN 202155258 U 3/2012
JP 2001026770 A * 1/2001

(Continued)

*Primary Examiner* — George Nguyen
(74) *Attorney, Agent, or Firm* — Muncy, Geissler, Olds & Lowe, P.C.

(57) ABSTRACT

The present invention relates to a low magnetic chemical mechanical polishing conditioner and a method for producing the same. The method comprises: providing a substrate; providing a bonding layer disposed on the substrate; and providing a plurality of abrasive particles placed on the bonding layer, and the abrasive particles are placed on the substrate by the bonding layer; wherein the abrasive particles are screened into a non-magnetic content or a low magnetic content through a magnetic separation device. Therefore, the abrasive particles used in the low magnetic chemical mechanical polishing conditioner of the present invention are non-magnetic abrasive particles perfectly to avoid influence of polishing performance due to magnetic abrasive particles.

15 Claims, 2 Drawing Sheets

(56) References Cited

U.S. PATENT DOCUMENTS 5,887,728 A * 3/1999 Muranaka ..... B03B 9/061 209/214
5,931,309 A * 8/1999 Andersson ..... B03C 1/22 209/215
6,159,087 A * 12/2000 Birang ..... B24B 53/017 451/526
6,190,240 B1 * 2/2001 Kinoshita ..... B24B 53/017 451/443
6,213,856 B1 * 4/2001 Cho ..... B24B 53/017 451/443
6,318,558 B1 * 11/2001 Exner ..... B03C 1/23 209/2
6,884,155 B2 * 4/2005 Sung ..... B24B 53/017 451/285
6,945,857 B1 * 9/2005 Doan ..... B24B 53/017 451/443
7,040,969 B1 * 5/2006 Chikuba ..... B03C 1/28 451/450
7,201,645 B2 * 4/2007 Sung ..... B24B 53/017 451/285
7,491,116 B2 * 2/2009 Sung ..... B24B 53/017 451/443
7,690,971 B2 * 4/2010 Sung ..... B24D 18/0009 451/443
8,002,861 B2 * 8/2011 Boussant-Roux .. B24B 27/0633 451/28
2002/0066233 A1 * 6/2002 McArdle ..... B24D 3/04 51/308
2003/0194947 A1 * 10/2003 Bright ..... B24B 5/363 451/28
2007/0049185 A1 * 3/2007 Lin ..... B24D 3/14 451/443
2007/0084131 A1 * 4/2007 Palmgren ..... B24D 11/00 51/293
2010/0273402 A1 * 10/2010 Shimizu ..... B24B 53/017 451/56
2011/0146526 A1 * 6/2011 Plyler ..... B03C 1/20 104/2
2012/0231711 A1 * 9/2012 Keipert ..... C09K 3/1409 451/534
2013/0244552 A1 * 9/2013 Lee ..... B24B 53/017 451/443
2013/0273820 A1 * 10/2013 Sung ..... B01J 3/062 451/443
2015/0210890 A1 * 7/2015 Nagai ..... B24B 57/02 51/309

FOREIGN PATENT DOCUMENTS

JP 4890900 B2 * 3/2012
TW 204632 4/1993
TW I290876 12/2007

* cited by examiner

LOW MAGNETIC CHEMICAL MECHANICAL POLISHING CONDITIONER

CROSS REFERENCE TO RELATED APPLICATION

This application claims the benefits of the Taiwan Patent Application Serial Number 102147394, filed on Dec. 20, 2013, the subject matter of which is incorporated herein by reference.

BACKGROUND OF THE INVENTION

1. Field of the Invention

The present invention relates to a low magnetic chemical mechanical polishing conditioner, and more particularly to a chemical mechanical polishing conditioner formed by abrasive particles with low magnetic contents.

2. Description of Related Art

Chemical mechanical polishing (CMP) is a common polishing process in various industries, which can be used to grind the surfaces of various articles, including ceramics, silicon, glass, quartz, or a metal chip. In addition, with the rapid development of integrated circuits, chemical mechanical polishing becomes one of the common techniques for wafer planarization because it can achieve an object of whole planarization.

During the chemical mechanical polishing process of semiconductor, impurities or uneven structure on the surface of a wafer are removed by contacting the wafer (or the other semiconductor elements) with a polishing pad and using a polishing liquid if necessary, through the chemical reaction and mechanical force. When the polishing pad has been used for a certain period of time, the polishing performance and efficiency are reduced because the debris produced in the polishing process may accumulate on the surface of the polishing pad. Therefore, a conditioner can be used to condition the surface of the polishing pad, such that the surface of the polishing pad is re-roughened and maintained at an optimum condition for polishing. In the process for manufacturing a conditioner, it is necessary to dispose an abrasive layer by mixing abrasive particles and a binding layer on the substrate surface, and to fix the abrasive layer to the surface of the substrate by brazing or sintering methods.

Besides, in the process for manufacturing these abrasive particles, these abrasive particles have magnetic property due to frication or collision; however, diamonds with magnetic property will be attracted iron debris produced in the copper process, thereby influencing quality of abrasive particles. Therefore, it is necessary to screen the abrasive particles on the chemical mechanical polishing conditioner to obtain the abrasive particles without magnetic property, in order to maintain an optimum condition for polishing. In present technology, a magnetic separator is used to adsorb and remove substances with magnetic property, when materials pass through the magnetic separator; the substances with magnetic property are adsorbed by a magnetic bar to accomplish an effect for screening substances with magnetic property. Besides, in present technology, there is another method for screening substances with magnetic property is also used, in which a dry magnetic separator is used to purify and classify diamonds to remove diamonds with magnetic property.

In the known technology, such as Taiwan Patent Issue No. 204632, it discloses that a belt conveyor consists of the belt which is wound around a driving roller at one end and is wound around the nonmetallic cylindrical body at the other end and a rotary magnet which is alternately magnetized to N poles and S pole at the circumferential edge. This rotary magnet is rotated in the same direction at the rotating speed higher than the rotating speed of the cylindrical body, by which the nonmagnetic metallic refuse component are discharged from the other end of the belt in the locus different from the locus of the refuse components of the other components. The refuse components are thereby separated. The driven roller is disposed with the deviation further outward from the above-mentioned other end below the cylindrical body and the belt is wound around this roller as well. Consequently, the damaging of the belt is prevented even if the refuse such as washers or such iron scrap having edges resembling the shapes thereof exists in the refuse.

Besides, in the other known technology, such as China Utility Model Patent Issue No. 202155258U, it discloses a dry magnetic separator for purification, selection and grading of ultra-hard materials, which comprises a frame, a magnetic roll, a magnetic roll adjusting mechanism, a casing and a driving motor. A feeding bin is arranged at the top of the casing and communicated with the casing through a discharging port, a non-magnetic material bin and a magnetic material bin are disposed on the lower portion of the casing, a separation split tip is arranged at the joint of the non-magnetic material bin and the magnetic material bin, and a scraper is arranged on one side of the separation split tip. The dry magnetic separator can better realize industrial production of purifying and grading of weak-magnetic ultra-hard materials such as artificial diamond, cubic boron nitride and the like, and has the advantages of convenience in use, stability and reliability in quality of separated products and the like.

However, a magnetic field gradient method or a magnetic track method and so on are mainly used to screen diamonds in the above-mentioned known technology, in order to screen and separate metallic or inorganic particles with magnetic property or non-magnetic property. However, the abrasive particles through above-mentioned screening method and screening results are not necessarily to chemical mechanical polishing conditioner. Therefore, there is an urgent need for a screening method adequate for a chemical mechanical polishing conditioner, which can be used to screen and remove particles with magnetic property included in abrasive particles before manufacturing the conditioner to obtain abrasive particles with low magnetic contents adequate for the chemical mechanical polishing conditioner, and the chemical mechanical polishing conditioner with low magnetic property is manufactured and formed by the abrasive particles with low magnetic contents to improve magnetic attracting questions between the magnetic abrasive particles and abrasive debris or abrasive impurities, thereby maintaining the polishing performance of the chemical mechanical polishing conditioner.

SUMMARY OF THE INVENTION

An object of the present invention is to provide a low magnetic chemical mechanical polishing conditioner, which is used to remove magnetic diamonds before the brazing process to obtain the abrasive particles adequate for chemical mechanical polishing conditioner.

To achieve the above object, the present invention provides a low magnetic chemical mechanical polishing conditioner, comprising: a substrate; a binding layer disposed on a surface of the substrate; and a plurality of abrasive particles embedded in a surface of the binding layer and fixed to the surface of the substrate by the binding layer; wherein the abrasive particles are screened into a non-magnetic content or a low magnetic content through a magnetic separation device.

In the chemical mechanical polishing conditioner, which is made mainly of a substrate, a binding layer and a plurality of abrasive particles (namely, diamond particles); therefore, properties of these abrasive particles affect seriously the polishing performance of the chemical mechanical polishing conditioner, and an important index of the abrasive particles properties is a non-magnetic level. In above-mentioned low magnetic chemical mechanical polishing conditioner of the present invention, the abrasive particles are screened into non-magnetic abrasive particles and magnetic abrasive particles under magnetic screening mechanism of a specific magnetic strength and rotating speed of a magnetic wheel, a feed track and spaces between the magnetic wheels.

In above-mentioned low magnetic chemical mechanical polishing conditioner of the present invention, these abrasive particles can include non-magnetic abrasive particles and magnetic abrasive particles before magnetic screening; wherein the magnetic content mean a number percentage of the screened magnetic abrasive particles based on total abrasive particles. It means more impurities included in the abrasive particles, if the magnetic content is higher, and impurities included in the abrasive particles may attract iron debris produced in the copper process because of the abrasive particles without magnetic property. Besides, the strength of the abrasive particles becomes low due to impurities included in the abrasive particles, so that abrasive particles on the chemical mechanical polishing conditioner may break easily when using by the user. Besides, in above-mentioned low magnetic chemical mechanical polishing conditioner of the present invention, the non-magnetic content means the number percentage of the magnetic abrasive particles is 0, and the low magnetic content means the number percentage of the magnetic abrasive particles is 0.1 to 5.0.

In above-mentioned low magnetic chemical mechanical polishing conditioner of the present invention, the magnetic separation device may include a feed track, a magnetic wheel and an abrasive collecting tank; wherein the abrasive collecting tank may include a magnetic abrasive collecting tank and a non-magnetic abrasive collecting tank, and the non-magnetic abrasive collecting tank is located at an end near the feed track, the magnetic abrasive collecting tank is located another end far away the feed track. In above-mentioned low magnetic chemical mechanical polishing conditioner of the present invention, abrasive particles to be screened are transported to the magnetic wheel through the feed track. Furthermore, the non-magnetic abrasive particles are fallen directly into the non-magnetic abrasive collecting tank located one end near the feed track, because the non-magnetic abrasive particles cannot attract the surface of the magnetic wheel. On the other hand, the magnetic abrasive particles are fallen into the magnetic abrasive collecting tank located at another end far away the feed track, because the magnetic abrasive particles can attract the surface of the magnetic wheel, thereby accomplishing an object for magnetic screening.

In above-mentioned low magnetic chemical mechanical polishing conditioner of the present invention, in the process of magnetic screening, because the amounts of abrasive particles to be screened are too much, the all magnetic abrasive particles are not totally fallen into the magnetic abrasive tank as expected; thus, a few magnetic abrasive particles are still are present in the non-magnetic abrasive tank. Therefore, it is necessary to screen these abrasive particles obtained in the non-magnetic abrasive particles twice or three times, so that contents of the magnetic abrasive particles present in the non-magnetic abrasive tank can be less than a magnetic content standard which can be permitted by the user. In above-mentioned low magnetic chemical mechanical polishing conditioner of the present invention, the contents of the abrasive particles capable of permitting in the non-magnetic abrasive tank may be randomly varied based on the user's requirements or degree of permission of the magnetic contents; wherein when the number percentage of the magnetic abrasive particles collected in the non-magnetic abrasive tank is less than a required value, these abrasive particles collected in the non-magnetic abrasive tank are screened again. In an aspect of the present invention, the required value is set to be 20.0. When the number percentage of the magnetic abrasive particles collected in the non-magnetic abrasive tank is more than 20.0, these abrasive particles collected in the non-magnetic abrasive tank are screened again. In an aspect of the present invention, the required value is set to be 10.0. When the number percentage of the magnetic abrasive particles collected in the non-magnetic abrasive tank is more than 10.0, these abrasive particles collected in the non-magnetic abrasive tank are screened again. In another aspect of the present invention, the required value is set to be 5.0. When the number percentage of the magnetic abrasive particles collected in the non-magnetic abrasive tank is more than 5.0, these abrasive particles collected in the non-magnetic abrasive tank are screened again.

In above-mentioned low magnetic chemical mechanical polishing conditioner of the present invention, the magnetic strength of the magnetic wheel may be randomly varied based on the user's requirements or degree of permission of the magnetic contents. If the magnetic strength is higher, an ability of the magnetic screening is more preferably, which can reduce the magnetic abrasive particles fallen in the non-magnetic abrasive tank, but it also cause the increased cost of electricity used in the magnetic separation device; wherein the magnetic strength of the magnetic wheel may be 1,200 to 20,000 Gauss, in an aspect of the present invention, the magnetic strength of the magnetic wheel may be 2,000 Gauss to 15,000 Gauss, and in another aspect of the present invention, the magnetic strength of the magnetic wheel may be 10,000 Gauss.

In above-mentioned low magnetic chemical mechanical polishing conditioner of the present invention, a rotating speed of the magnetic wheel may be randomly varied based on the user's requirements or degree of permission of the magnetic contents. If the rotating speed of the magnetic wheel is faster, the screening time may be shorten, but errors may be increased in the screening results; wherein the rotating speed of the magnetic wheel is 2 rpm to 2,000 rpm, in an aspect of the present invention, the rotating speed of the magnetic wheel is 100 rpm to 1,500 rpm, and in another aspect of the present invention, the rotating speed of the magnetic wheel is 1,000 rpm.

In above-mentioned low magnetic chemical mechanical polishing conditioner of the present invention, spaces between the feed track and the magnetic wheel may be randomly varied based on the user's requirements or degree of permission of the magnetic contents. If the spaces between the feed track and the magnetic wheel are smaller, these abrasive particles may be screened strictly by the magnetic wheel, but the time of magnetic screening is increased; wherein the spaces between the feed track and the magnetic wheel may be 2 to 50 times of the particles sizes of abrasive particles, in an aspect of the present invention, the spaces between the feed track and the magnetic wheel may be 3 times of the particles sizes of abrasive particles.

In above-mentioned low magnetic chemical mechanical polishing conditioner of the present invention, a movement way of theses abrasive particles on the feed track may be randomly varied based on the user's requirements or degree of permission of the magnetic contents. In an aspect of the present invention, theses abrasive particles on the feed track are moved by a vibration way. In above-mentioned low magnetic chemical mechanical polishing conditioner of the present invention, a movement speed of the feed track may be randomly varied based on the user's requirements or degree of permission of the magnetic contents. If the movement speed of these abrasive particles on the feed track is faster, the time of magnetic screening may be shorten, but the errors are increased in the results of the magnetic screening; wherein the movement speed of these abrasive particles on the feed track may be 10 mm/min to 1,000 mm/min, in an aspect of the present invention, the movement speed of these abrasive particles on the feed track may be 100 mm/min to 800 mm/min, and in another aspect of the present invention, the movement speed of these abrasive particles on the feed track may be 500 mm/min.

In above-mentioned low magnetic chemical mechanical polishing conditioner of the present invention, these abrasive particles may be artificial diamonds, nature diamonds, polycrystalline diamonds or cubic boron nitride. In a preferred aspect of the present invention, the abrasive particles may be artificial diamonds. Furthermore, in above-mentioned the chemical mechanical polishing conditioner with high quality abrasive particles of the present invention, the abrasive particles may have a particle size of 30 to 600 μm. In a preferred aspect of the present invention, the abrasive particles may have a particle size of 300 μm.

In above-mentioned low magnetic chemical mechanical polishing conditioner of the present invention, the compositions of the binding layer or the abrasive particles may be varied based on the polishing conditions and requirements, which includes a ceramic material, a brazing material, an electroplating material, a metallic material, or a polymer material, but the present invention is not limited thereto. In an aspect of the present invention, the binding layer can be made of a brazing material, wherein the brazing material can be at least one selected from the group consisting of iron, cobalt, nickel, chromium, manganese, silicon, aluminum, and combinations thereof. In another aspect of the present invention, the polymer material can be epoxy resin, polyester resin, polyacrylic resin, or phenolic resin. Besides, in above-mentioned low magnetic chemical mechanical polishing conditioner of the present invention, the materials and sizes of the substrate may be varied based on the polishing conditions and requirements; wherein the materials of the substrate can be stainless steel, mold steel, metal alloy, ceramic material or polymer material etc., but the present invention is not be limited thereto. In a preferred aspect of the present invention, the material of the substrate may be a stainless steel substrate.

In summary, according to low magnetic chemical mechanical polishing conditioner of the present invention, these abrasive particles are screened by the magnetic separation device, the non-magnetic abrasive particles and magnetic abrasive particles are collected respectively after screening, and the abrasive particles are obtained based on the user's requirements through multiple screening to improve the polishing performance in the following process by means of the screening way and screening conditions of diamonds of the present invention.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

Hereinafter, the actions and the effects of the present invention will be explained in more detail via specific examples of the invention. However, these examples are merely illustrative of the present invention and the scope of the invention should not be construed to be defined thereby.

EXAMPLE 1

Figure 1:
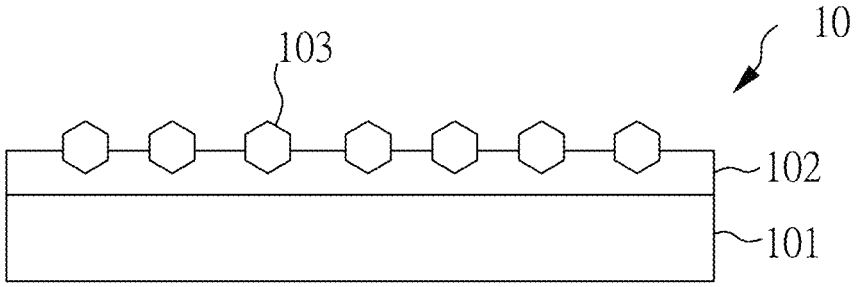
FIG. 1 shows a schematic diagram of low magnetic chemical mechanical polishing conditioner of the present invention.

In low magnetic chemical mechanical polishing conditioner of the present invention, these abrasive particles may be screened by a magnetic separation device, and the low magnetic abrasive particles are obtained after screening to be used to manufacture a chemical mechanical polishing conditioner. Please refer to FIG. 1, FIG. 1 shows a schematic diagram of low magnetic chemical mechanical polishing conditioner of the present invention. As shown in FIG. 1, low magnetic chemical mechanical polishing conditioner 10 of the present invention, comprising a substrate 101 made of stainless steel material; a binding layer 102 made of a nickel-based metallic brazing material; and a plurality of abrasive particles 103 embedded in the binding layer 102 by a brazing method, and these abrasive particles 103 fixed to the surface of the substrate by the binding layer 102; wherein these abrasive particles 103 are formed of artificial diamonds having particle sizes of 300 μm, and the abrasive particles 103 are disposed by using a known diamond distribution technique (for example, template distribution), and the spacing and arrangement of the abrasive particles 12 are controlled by the template (not shown in figures). Further, theses abrasive particles 103 are all toward upper to form a directivity of an abrasive surface of these tips, alternately, these abrasive particles 103 having the same or different directivity may be randomly varied based on the user's requirements or polishing condition.

Figure 2:
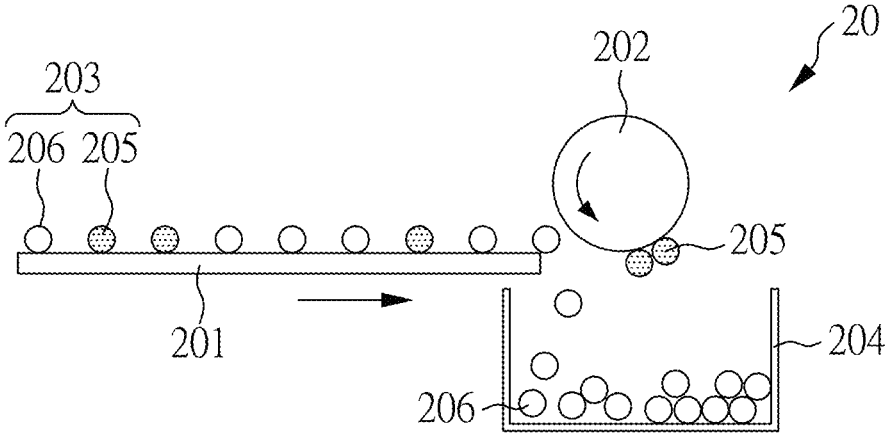
FIG. 2 shows a schematic diagram of a magnetic separation device of low magnetic chemical mechanical polishing conditioner according to Example 1 of the present invention.

Please refer to FIG. 2, FIG. 2 shows a schematic diagram of a magnetic separation device of low magnetic chemical mechanical polishing conditioner according to Example 1 of the present invention. As shown in FIG. 2, in low magnetic chemical mechanical polishing conditioner of the present invention, these abrasive particles 203 include a few magnetic abrasive particles 205 and most non-magnetic abrasive particles 206, so that theses abrasive particles 203 are screened by a magnetic separation device 20 which comprises a feed track 201, a magnetic wheel 202 and an abrasive collecting tank 204; wherein theses abrasive particles 203 are moved on the feed track 201 by a vibration way. Further, a moving speed of these abrasive particles 203 on the feed track 201 is 500 mm/min, the magnetic strength of the magnetic wheel 202 is 10,000 Gauss, and the rotating speed of the magnetic wheel 202 is 1,000 rpm. Besides, a space between the feed track 201 and the magnetic wheel 202 may be 3 times of the particle sizes of theses abrasive particles 203. First, abrasive particles 203 to be screened are disposed on the feed track 201, when theses abrasive particles 203 are transported to the magnetic wheel 202, the magnetic abrasive particles 205 will be attracted on the surface of the magnetic wheel 202, and the magnetic strength of the magnetic wheel 202 is turned off after screening these abrasive particles 203 to remove the magnetic abrasive particles 205 attracted on the surface of the magnetic wheel 202. On the other hand, the non-magnetic abrasive particles 206 will not be attracted to the magnetic wheel 202 but fallen directly into the abrasive collecting tank 204. Then, the abrasive collecting tank 204 cannot only collect the non-magnetic abrasive particles 206 as necessary, but also can collect a few magnetic abrasive particles 205 due to a limitation of screening ability during the magnetic screening process; therefore, a number percentage of the magnetic abrasive particles 205 in the abrasive collecting tank 204 can be calculated by a random sampling method in general statistics, namely, so called magnetic content, and whether theses abrasive particles 203 collected in the abrasive collecting tank 204 conform a standard of a non-magnetic content or a low magnetic content or not; wherein the non-magnetic content is a number percentage of the magnetic abrasive particles to be 0, and the low magnetic content is a number percentage of the magnetic abrasive particles to be 0.1 to 5.0 in Example 1. When theses abrasive particles 203 collected in the abrasive collecting tank 204 can be less than a standard of low magnetic content, theses abrasive particles 203 can be used to manufacture low magnetic chemical mechanical polishing conditioner.

EXAMPLE 2

Figure 3:
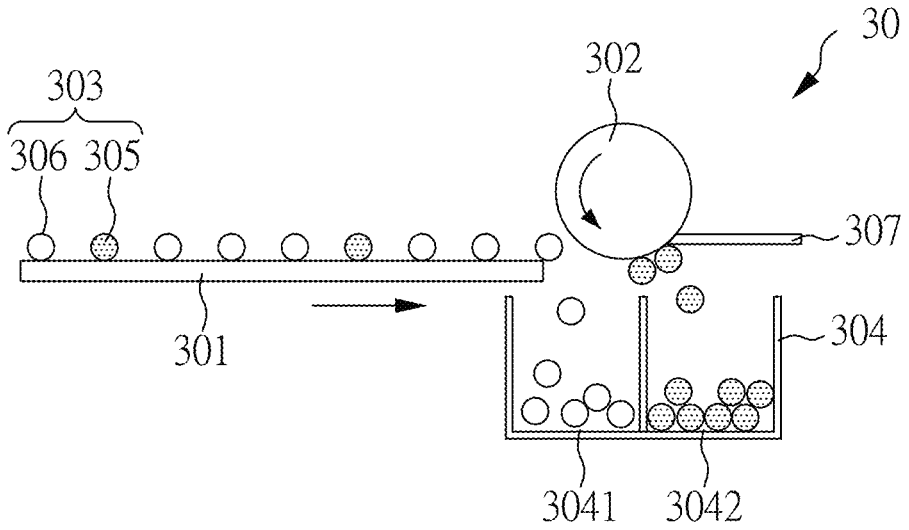
FIG. 3 shows a schematic diagram of a magnetic separation device of low magnetic chemical mechanical polishing conditioner according to Example 2 of the present invention.

Please refer to FIG. 3, FIG. 3 shows a schematic diagram of a magnetic separation device of low magnetic chemical mechanical polishing conditioner according to Example 2 of the present invention. The magnetic separation device of the chemical mechanical polishing conditioner of Example 2 is substantially the same as the above Example 1, but the differences are that the abrasive collecting tank 204 of Example 1 is used to collect the non-magnetic abrasive particles 206; however, the abrasive collecting tank of Example 2 can be used to the collect magnetic abrasive particles 305 and the non-magnetic abrasive particles 306 simultaneously. As shown in FIG. 3, the abrasive collecting tank 304 including the magnetic separation device 30 can include a non-magnetic abrasive tank 3041 and a magnetic abrasive tank 3042, when theses abrasive particles 303 are screened, these abrasive particles 303 include a few contents of the magnetic abrasive particles 305 and most contents of non-magnetic abrasive particles 306. The abrasive particles 303 to be screened are disposed on the feed track 301, when these abrasive particles 303 are transported to the magnetic wheel 302, the magnetic abrasive particles 305 will be attracted to a surface of the magnetic wheel 302, and these magnetic abrasive particles 305 will be separated by a brush 307 or a baffle, so that these magnetic abrasive particles 305 are fallen into the magnetic abrasive tank 3042 of the abrasive collecting tank 304 far away the feed track 301. On the other hand, the non-magnetic abrasive particles 306 may not be attracted to the magnetic wheel 302, but they are fallen directly into the non-magnetic abrasive tank 3041 of the abrasive collecting tank 304 near the feed track 301.

EXAMPLE 3

The magnetic separation device of the chemical mechanical polishing conditioner of Example 3 is substantially the same as the above Example 2, but the differences are that these abrasive particles of Example 2 are screened once; however, these abrasive particles of Example 3 are judged to screen two times or to screen again according to the magnetic contents of the obtained abrasive particles 303 in the non-magnetic abrasive tank 3041. Please refer to FIG. 3 together, in the non-magnetic abrasive tank 3041, the collected non-magnetic abrasive particles 306 are taken some, such as 100, as statistical samples. Further amounts of the magnetic abrasive particles 305 mixed together the non-magnetic abrasive particles 306 are directly screened and distinguished by a magnet, and then the amounts of the magnetic abrasive particles 305 included in the abrasive particles 303 collected in the non-magnetic abrasive tank 3041 are calculate by a statistical method, that is the magnetic contents. When the number percentage of the magnetic abrasive particles 305 collected into the non-magnetic abrasive tank 3041 is more than 5.0, non-magnetic abrasive particles 306 collected into the non-magnetic abrasive tank 3041 are screened again, so that the non-magnetic abrasive particles 306 may be performed the magnetic screening for several times, thereby collecting abrasive particles 303 into the non-magnetic abrasive tank 3041 having the magnetic contents based on the user's requirements.

EXAMPLE 4

The magnetic separation device of the chemical mechanical polishing conditioner of Example 4 is substantially the same as the above Example 2, but the differences are that the magnetic strength of the magnetic wheel of Example 2 is 10,000 Gauss; however, the magnetic strength of the magnetic wheel of Example 4 is further increased. Please refer to FIG. 3 together, the magnetic strength of the magnetic wheel 302 is increased to 15,000 Gauss, and the magnetic wheel 302 has stronger magnetic attraction, so that the contents of the magnetic abrasive particles 305 mixed together the non-magnetic abrasive tank 3041 reduces to avoid destroying the polishing performance of the chemical mechanical polishing conditioner due to the magnetic abrasive particles 305.

It should be understood that these examples are merely illustrative of the present invention and the scope of the invention should not be construed to be defined thereby, and the scope of the present invention will be limited only by the appended claims.

What is claimed is:

1. A method for manufacturing a low magnetic chemical mechanical polishing conditioner, comprising:

providing a substrate;

providing a binding layer disposed on a surface of the substrate; and providing a plurality of abrasive particles embedded in the binding layer and fixed to the substrate by the binding layer;

wherein the abrasive particles are screened into a non-magnetic content or a low magnetic content through a magnetic separation device, wherein the non-magnetic content means a number percentage of magnetic abrasive particles to be 0, and the low magnetic content means a number percentage of magnetic abrasive particles to be 0.1 to 5.0.

2. The method for manufacturing a low magnetic chemical mechanical polishing conditioner of claim 1, wherein the magnetic separation device comprises a feed track, a magnetic wheel and an abrasive collecting tank.

3. The method for manufacturing a low magnetic chemical mechanical polishing conditioner of claim 2, wherein the abrasive collecting tank comprises a magnetic abrasive tank and a non-magnetic abrasive tank, in which the non-magnetic abrasive tank is located at an end near the feed track, and the magnetic abrasive tank is located at another end far away the feed track.

4. The method for manufacturing a low magnetic chemical mechanical polishing conditioner of claim 3, wherein when a number percentage of magnetic abrasive particles collected into the non-magnetic abrasive tank is not reached a standard value, these abrasive particles collected into non-magnetic abrasive tank are screened again.

5. The method for manufacturing a low magnetic chemical mechanical polishing conditioner of claim 2, wherein a magnetic strength of the magnetic wheel is 1,200 Guass to 20,000 Gauss.

6. The method for manufacturing a low magnetic chemical mechanical polishing conditioner of claim 2, wherein a rotating speed of the magnetic wheel is 2 rpm to 2,000 rpm.

7. The method for manufacturing a low magnetic chemical mechanical polishing conditioner of claim 2, wherein a space between the feed track and magnetic wheel is 2 to 50 times of the particle sizes of theses abrasive particles.

8. The method for manufacturing a low magnetic chemical mechanical polishing conditioner of claim 2, wherein a moving speed of these abrasive particles on the feed track is 10 mm/min to 1,000 mm/min.

9. The method for manufacturing a low magnetic chemical mechanical polishing conditioner of claim 1, wherein the abrasive particles are artificial diamonds, nature diamonds, polycrystalline diamonds or cubic boron nitride.

10. The method for manufacturing a low magnetic chemical mechanical polishing conditioner of claim 1, wherein the abrasive particles have a particle size of 30 to 600μm.

11. The method for manufacturing a low magnetic chemical mechanical polishing conditioner of claim 1, wherein a composition of the binding layer is made of a ceramic material, a brazing material, an electroplating material, a metallic material, or a polymer material.

12. The method for manufacturing a low magnetic chemical mechanical polishing conditioner of claim 11, wherein the brazing material is at least one selected from the group consisting of iron, cobalt, nickel, chromium, manganese, silicon, aluminum, and combinations thereof.

13. The method for manufacturing a low magnetic chemical mechanical polishing conditioner of claim 11, wherein the polymer material is epoxy resin, polyester resin, polyacrylic resin, phenolic resin.

14. The method for manufacturing a low magnetic chemical mechanical polishing conditioner of claim 1, wherein the substrate is made of stainless steel substrate, mold steel substrate, metal alloy substrate, ceramic material substrate or polymer material substrate or combinations thereof.

15. A low magnetic chemical mechanical polishing conditioner is made by a method according to claim 1.

* * * * *